United States Patent [19]

Murphy et al.

[11] 4,246,088

[45] Jan. 20, 1981

[54] METHOD AND APPARATUS FOR ELECTROLYTIC TREATMENT OF CONTAINERS

[75] Inventors: Thomas P. Murphy, Wantage; George Bell, Radlett; Fred Fidler, Cuffley, all of England

[73] Assignee: Metal Box Limited, Reading, England

[21] Appl. No.: 6,206

[22] Filed: Jan. 24, 1979

[51] Int. Cl.[3] ..... C25D 7/04; C25D 13/14; C25F 1/00

[52] U.S. Cl. ..... 204/181 R; 204/181 C; 204/300 EC; 204/25; 204/26; 204/141.5; 204/58; 204/199; 204/272; 204/275

[58] Field of Search ..... 204/181 C, 181 R, 299 EC, 204/300 EC, 25, 26, 51, 141.5, 146, 199, 200, 272, 275, 32 R

[56] References Cited

U.S. PATENT DOCUMENTS

| | | | |
|---|---|---|---|
| 3,620,952 | 11/1971 | Chiappe | 204/26 |
| 3,849,284 | 11/1974 | Kossmann | 204/181 R |
| 3,922,213 | 11/1975 | Smith et al. | 204/181 R |
| 3,969,136 | 7/1976 | Miskech | 134/48 |
| 4,094,760 | 6/1978 | Smith et al. | 204/181 C |
| 4,107,016 | 8/1978 | Brower et al. | 204/300 EC |

FOREIGN PATENT DOCUMENTS

| | | | |
|---|---|---|---|
| 479746 | 2/1938 | United Kingdom | 204/26 |

*Primary Examiner*—Howard S. Williams
*Attorney, Agent, or Firm*—Diller, Ramik & Wight

[57] ABSTRACT

Apparatus for electrolytically treating containers comprising a cell assembly having a cell wall surrounding a mandrel and a lid cooperating with the mandrel and cell wall to form a cavity for the reception of a container, conduit means for introducing an electrolyte into said cavity, and the conduit means including selectively operable port means for (a) conducting electrolyte through said cavity such that only the outside surface of the container can be electrolytically treated and (b) for conducting electrolyte through said cavity such that only the inside surface of the container can be electrolytically treated and (c) for conducting electrolyte through said cavity such that both the inside and outside surfaces of the container can be simultaneously electrolytically treated.

18 Claims, 7 Drawing Figures

METHOD AND APPARATUS FOR ELECTROLYTIC TREATMENT OF CONTAINERS

This invention relates to the electro-chemical treatment of a surface of a container and more particularly but not exclusively to a method and apparatus for electrolytically treating a container body drawn from sheet metal.

Container bodies are known which are drawn from sheet metal to have a cylindrical side wall closed at one end by an end wall. During the drawing process the surfaces of the sheet metal are subjected to frictional engagement with the drawing tools and the surface may become scratched or generally disturbed. This disturbance is more apparent on containers which have been wall ironed than on containers which have been redrawn with a positive clearance between punch and die.

The tinplates, used for the manufacture of drawn containers, comprise a layer of tin on the mild steel substrate. The surface of the tin is usually passivated by a known chemical treatment. When the passivated tinplate is drawn, in a press tool, the tin layer is subjected to frictional engagement with the tool surface and so the passivated layer is liable to be destroyed. If the degree of drawing or redrawing is severe, as could be the case in a wall ironing operation, the tin layer may be broken to leave the steel beneath, exposed and vulnerable to attack when the container is packed with certain food products, as is well known in the art. One known remedy is to use tinplate having a thicker layer of tin but this is a costly remedy.

The aluminium sheet used for manufacture containers, is often anodised, etched or treated with chromates because such surface treatments help subsequent organic coatings to adhere to the sheet. As already explained, with reference to tinplate, these surface finishes for aluminium sheet may also be spoiled in the press tool and so with both drawn aluminium containers and drawn tinplate containers there is a need for a method and apparatus for repairing the surfaces of the containers after the metal working operations; such operations may include drawing; redrawing with a positive clearance; redrawing with a negative clearance herein called wall ironing; flanging or beading.

Tinplate container bodies having a side seam are commonly soldered. However, certain products require that the side seam be protected after forming, the usual remedy being the application of a stripe of organic lacquer. Tinplate container bodies having a welded side seam also suffer damage to the metal surface adjacent the weld and again there is a need for a method of repairing the interrupted surfaces of the metal of the side seam.

The application of organic coating materials to containers is often impeded by the presence of lubricants. The problem is more serious with wall ironed cans and so the cans are usually washed and dried before coating. British Pat. No. 1,498,795 describes a method and apparatus for cleaning can bodies by means of a solvent or detergent which removes the greasy lubricants. The method described therein comprises mounting the container in a cavity in a body; the cavity having a shape corresponding approximately to that of the container, with the walls of the cavity spaced close to the surfaces of the container; and the container sub-dividing the cavity into two chambers; and passing the cleaning fluid through the chambers so that the cleaning fluid fills the chambers and flows along the surfaces of the container. The flow is preferably turbulent to obtain a good cleaning action, in contrast to the galvanic actions which are the subject of this specification.

That is not to say that movement of fluids into and out of a treatment cell prevents the use of such an arrangement in an electro coating apparatus. In our British Pat. No. 1,117,831 apparatus is described in which a tubular side seamed can body is moved to surround an electrode and define with the electrode an electrocoating cell. Electrocoating material is passed into the space between the interior of the can body and the internal electrode and application of a potential difference between the can body and the electrode causes a current to pass through the coating material so that the internal surface of the can body becomes coated. The weight of coating applied to the body is proportional to the current passed. After coating the can the electrolyte is removed from the cell and the body is removed from the apparatus. However this apparatus is not capable of applying an external coating to the can body.

In our co-pending British Patent Application No. 46,460/76 an apparatus is described which would enable a container to be taken from the exit wheel of the can cleaning machine and returned via the entry wheel to another part of the cleaning machine. Combining the teaching of British Patent Application No. 46,460/76 and British Pat. No. 1,498,795 and the further adaption according to this invention provides an apparatus for repairing the surfaces of a container body using galvanic treatment processes. Such a repaired container may be used for such products as are packed in a plain can or may be coated with organic coatings for wider use.

In a first aspect the invention provides a method of treating a surface of a can body formed from sheet metal said method including the steps of placing the can body in a cell so that at least an exterior surface of the body is in close spaced relationship with the wall of the cell, entering an electrolyte between the wall of the cell and the exterior surface of the can and thereafter applying a potential difference between the can and the cell wall to treat the surface of the can.

In one embodiment the method includes the further steps of draining the electrolyte from the cell and thereafter removing the can from the cell.

In another embodiment the method includes the further steps of introducing a second electrolyte into the cell after removal of the first electrolyte and applying a second potential difference between the can and the cell to apply a second treatment to the exterior surface of the can.

In a further embodiment the method includes the steps of introducing an internal electrode into the can, entering an electrolyte between the interior of the can and the internal electrolyte; and applying a potential difference between the interior of the can and the internal electrode.

The electrolyte used to treat the inside surface of the can may also be used to treat the outside of the can.

The method may include anionic or cationic treatment or treatments of the surface of the can.

In a preferred method of treating a can drawn from tinplate the surface of the can is electrocleaned and repassivated. A coating of an electrocoating material is preferably applied to the repassivated surface.

In a preferred method of treating a can body drawn from tinplate and wall ironed to have a worked side wall, said method includes the steps of electrocleaning and electrodetinning.

The detinned surface is preferably electroplated with a coating containing chromium and thereafter electrocoated with an organic coating material.

In a second aspect the invention provides apparatus for treating an external surface of a can body formed from sheet metal, said apparatus comprising an electrochemical cell adapted to surround the surface to be treated in spaced close proximity thereto, means to create a potential difference between the body and the cell wall, and means to introduce an electrolyte into the space between the cell wall and external surface to be treated.

In one embodiment the apparatus comprises a cell having a cell wall and a mandrel said cell wall being adapted to surround a can placed therein, the said mandrel being adapted to enter the can, said cell wall and mandrel defining an electrode in close proximity to both the inside and outside surface of the can to be treated.

In another embodiment the apparatus has means to pass a first electrolyte between the outside surface of the can and the cell wall and a second electrolyte between the inside surface of the can and the mandrel, so that both inside and outside surfaces of the can may be treated simultaneously or sequentially.

An electrode may be used to press the flange of the can body into engagement with a spacer ring to hold the can body in close spaced proximity to the mandrel and cell wall, so that an electrolyte may be passed between the internal wall of the can body and the mandrel and between the external wall of the can body and the cell wall.

In a further aspect the invention provides a can made by a method according to the invention or by means of an apparatus according to the invention.

Various embodiments of the invention will now be described by way of example and with references to the accompanying examples and drawings in which.

Figure 1:
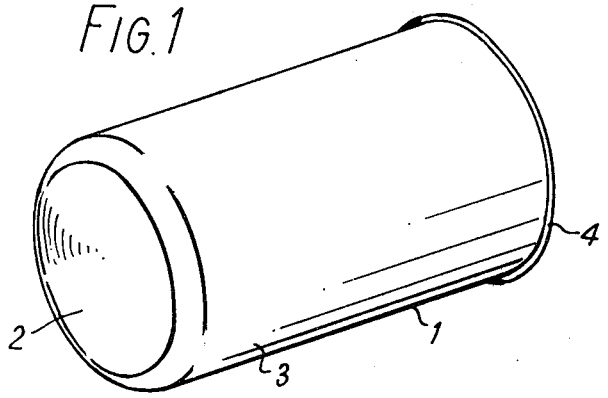
FIG. 1 is an open ended can body.

The can body 1 of FIG. 1 has a concave end wall 2 and a side wall 3 extending from the periphery of the end wall to terminate in a flange 4, which defines the open end of the can body.

The can body 1 has been drawn from a single piece of sheet metal, such as tinplate or aluminium and thereafter been wall ironed so that the side wall 3 is thinner than the end wall 2. The side wall is therefore in need of repair treatment to restore the surface while the surfaces of the concave end wall are substantially unaltered from the sheet condition.

Figure 2:
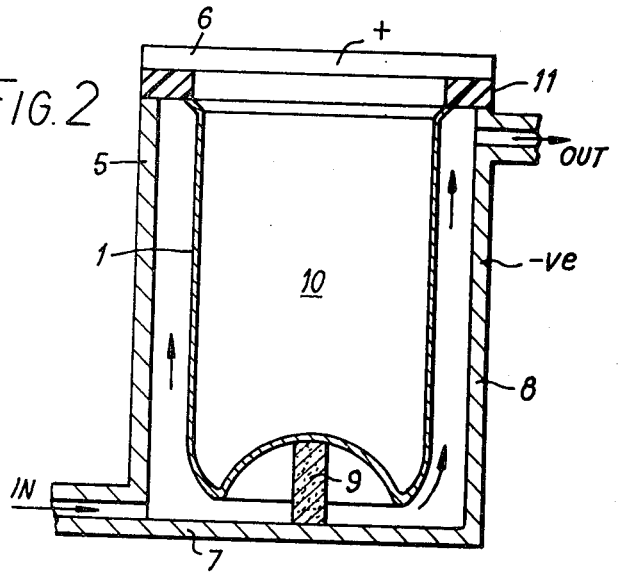
FIG. 2 is a side elevation sectioned on a diameter of apparatus for treating the outside of the can body of FIG. 1.

In FIG. 2 the can body 1 has been placed mouth upwards in apparatus comprising a cell 5 which is closed by a cover 6. The cell 5 has a bottom 7 and a sidewall 8 which surrounds the can body 1 in close spaced relationship, a typical distance between the side wall and can being less than 0.25 inches. An insulating post 9 extends axially up from the bottom 7 to keep the can body 1 off the bottom 7. An entry conduit for treating fluid is provided at the bottom of the cell and an exit conduit is provided.

The cover 6 has a mandrel 10, extending axially downwards therefrom into the cell 5, which serves to hold the can body 1 centrally within the cell 5 and firmly down on the insulating post 9 so that the external surface of the can body 1 is substantially evenly spaced from the internal surfaces of the cell 5. An insulating gasket 11 seals the joint between the lid 6 and the cell 5.

The lid 6 is given a positive polarity which is conducted through the mandrel 10 to the can body 1. The cell 5 is given a negative polarity, so that a direct current may be passed through a fluid in the cell. Therefore, when an electrocoating material is introduced as arrowed into the cell and a current is passed through the electrocoating material the can becomes coated with a surface coating. After coating the can, the spent electrocoating material is drained from the cell and the coated can is removed from the cell.

Figure 3:
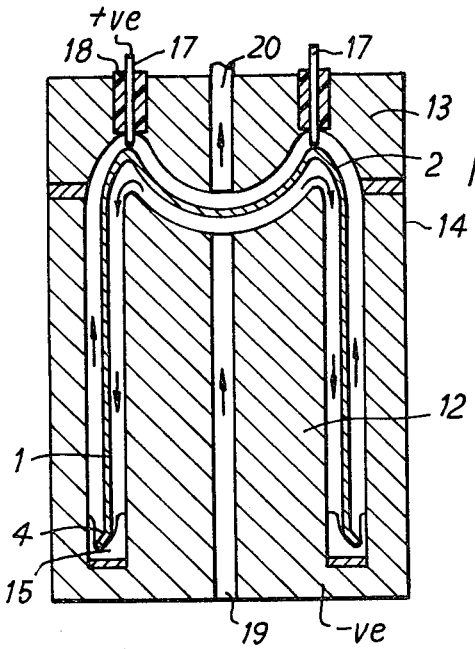
FIG. 3 is a side elevation, sectioned on a diameter of apparatus for treating both the outside and the inside of the can body of FIG. 1.

In FIG. 3 the can body 1 has been placed mouth downwards to surround a mandrel 12. The can body 1 is held centrally by the top electrodes 17 of a cell 14 holding it firmly in a ring 15 which has an annular groove (unnumbered) thereon to receive the flange 4. The ring 15 holds the flange of the can body clear of the cell to define a "U" shape passage for fluid to pass from the outside of the can to the inside. The contact post or electrodes 17 extend through an insulator 18 in the lid 13 or top wall, to engage with the bottom 2 of the can body.

The top wall 13 engages with the body of the cell 14 near the top of the cell 14 so that the outer wall of the cell 14 and mandrel 12 within define an electrode.

When a can body 1 has been positioned as shown in FIG. 3 the electrolyte is passed into the cell 14 through the central bore 19 in the mandrel 12 so that the electrolyte is deflected by the can bottom 2 to pass between the can 1 and the mandrel 12. Upon arriving at the ring 15 the electrolyte passes around the flanges 4 of the can to pass between the outside of the can and the wall of cell 14, and upwards to fill the cell.

When the cell is full of electrolyte a potential difference is applied between the cell 14 and the can 1 so that both the inside and the outside of the can are treated. After treatment the electrolyte is removed from the cell before removal of the can.

Figure 4:
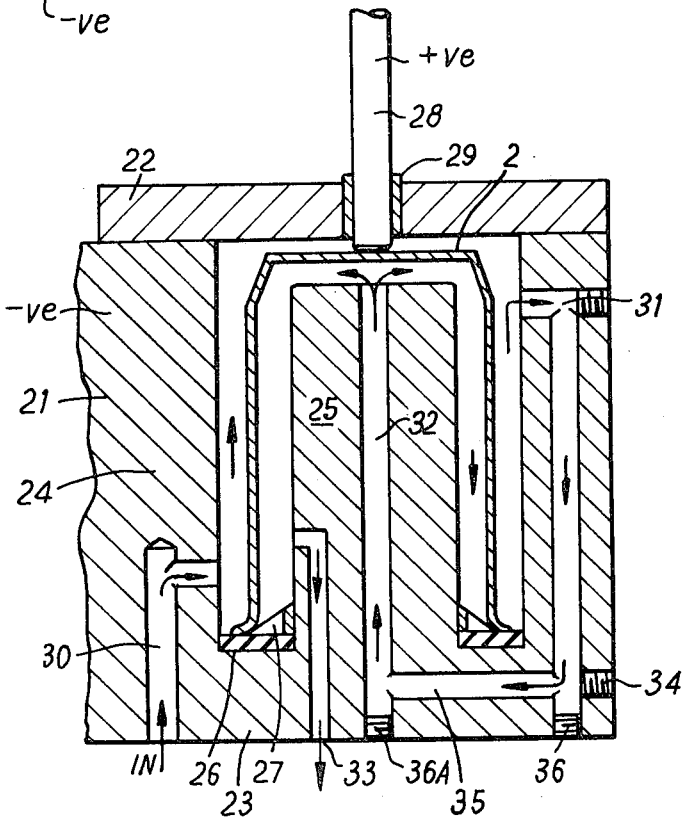
FIG. 4 is a sectioned side elevation of apparatus for treating both the inside and the outside of the can body of FIG. 1.

In FIG. 4, apparatus is shown which has passage ways as arrowed to conduct the treating fluid first across the external surface of the can body and then across the internal surface of the can body.

The apparatus of FIG. 4 comprises a cell 21 and a cover 22. The cell has a bottom wall 23 and a side wall 24. A mandrel 25 extends centrally upwards from the bottom wall 23 within the side wall 24 to define therewith, an annular cavity and to further define, with the cover 22, a space above the mandrel 25. An insulating locator ring 26 having triangular ribs 27 surrounds the mandrel 25 and rests on the bottom wall 23. The can body 1 is located centrally by the ribs 27 to be substantially equidistant from the side wall 24 and the mandrel 25.

A contact post 28 extends through an insulating grommet 29 to press on the end wall 2 the can body and so make good electrical contact.

In FIG. 4 the treating fluid enters through the bottom wall 23 via the passage 30 and passes as arrowed, between the exterior surface of the can body 1 and the interior surface of the cell side wall 24, to leave through the passage 31 which leads the treating fluid back towards the bottom wall 23 for entry into the central passage 32 in the mandrel 25. Upon emerging from the passage 32 the fluid impinges on the interior surface of the end wall 2 and passes on between the interior surface of the side wall of the can and the mandrel 25 to leave through the bottom wall 23 via passage 33.

It will be understood that the entry and exit from the cell through the bottom wall 23 permit convenient arrangements of feed pipes. Also, should it be desired to modify the cell of FIG. 4 to treat only an interior or an exterior surface of the can this may be achieved by movement of the plug 34 to block the passage 35 and removal of the base plugs 36 and 36A. Removal of the plug 36A also permits the use of a valved supply of compressed air to eject the can body from the cell 21.

It will be understood, that to fill the cavities completely and avoid residual remnants, the feed and exit conduits are preferably annular and arranged to distribute the treating fluid around the surface of the can.

It will be understood that the polarity of the cans and cells in FIGS. 2, 3 and 4 may be reversed but that it is preferable to have the cell members at an earthed polarity for safety.

Figure 5:
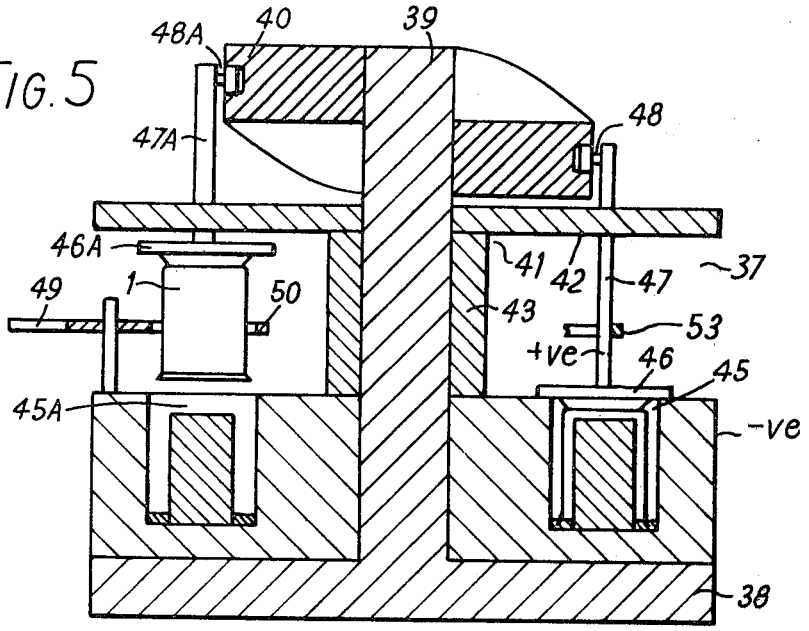
FIG. 5 is a diagrammatic sectioned side elevation of apparatus having a plurality of cells.
Figure 6:
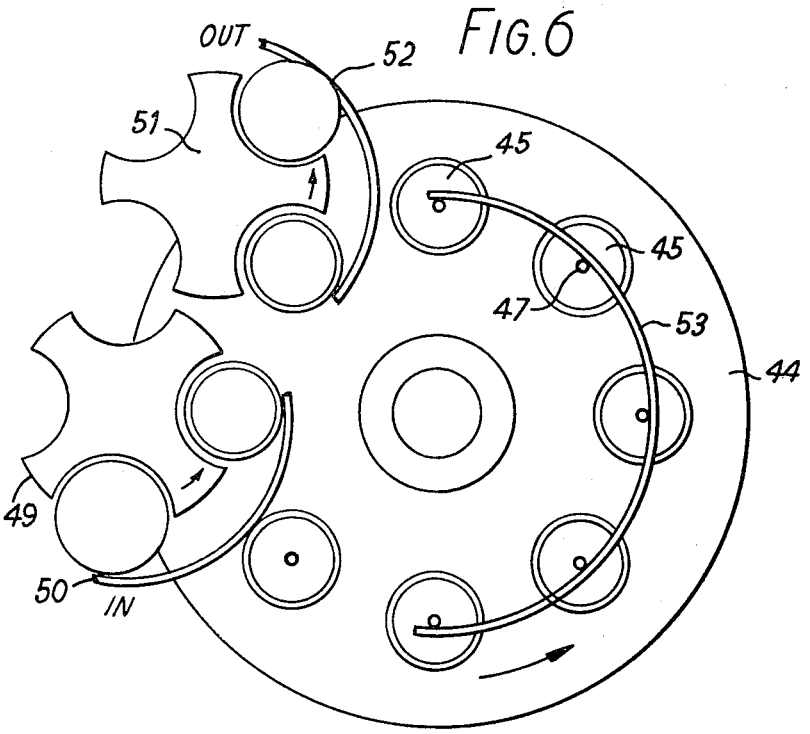
FIG. 6 is a plan view of the apparatus of FIG. 5.

The apparatus of FIG. 4 is particularly suitable for incorporation in a rotary machine having a plurality of such cells, such as is shown in FIGS. 5 and 6. Each cell is fed with fluids from supply means in the base 38 of the machine 37.

In FIG. 5 the machine 37 can be seen to have a base plate 38 from which extends a centre post 39 which supports a drum cam 40. A turret 41 rotates on the base plate 38, about the centre post 39. The turret comprises a top plate 42, a spacer 43 and a cell block 44. The equispaced arrangement of the cells 45 around the turret 41 is best seen in FIG. 6.

Each cell 45 is closed by a cover 46 supported on a rod 47 which is urged to reciprocate by a follower 48, at the upper end, which engages with the drum cam 40, the rod being insulated from the cover, turret and cam.

An entry star wheel 49 acting with an entry guide 50 brings each can body 1 in sequence to be fitted in a cell and after treatment an exit star wheel 51, acting with an exit guide 52 removes each can from the apparatus.

A positive polarity is imparted to the cans 1 in the cells and a negative polarity is put upon the cell block 44.

As shown in FIGS. 5 and 6 each cell is being used to perform a like treatment on each can body. The can body 1 is therefore placed in the cell 45A (beneath it as shown in FIG. 5) and as the turret 41 rotates about the central post 39 the co-operation of the follower 48A with the cam 40 causes the rod 47 to close the cover 46A into the cell 45A. The cell is then filled in a manner described with reference to FIG. 4. As the turret continues to rotate the rod 47A contacts the contact bar 53 which puts a positive potential onto the rod 47. The rod 47 conducts this polarity to the can body 1 in the cell so that for approximately 180° of rotation the galvanic treatment may be continued. If a cell, such as that shown in FIG. 4 is in use both the internal and external surfaces of the can body will be treated.

Various arrangements of the treatment cells are possible. A calculation of process parameters, based upon the foregoing design and involving a passivation surface treatment, similar to the known "311 treatment" given to tinplate, suggests that the processing of small cans (202×212) is quite feasible.

For example a 40 head unit with a throughput of 1,000 cans/minute could be constructed to fulfil the following requirements:

| | | | | |
|---|---|---|---|---|
| Time of component on unit | 2.4 secs. | | | |
| Time of surface treatment | (235° of cycle) 1.56 secs. | | | |
| Type of surface treatment | "311"30 coulombs/sq.ft. | | | |
| Can size | 202 × 212 | | 300 × 408¾ | |
| Extent of treatment | int. only | int.+ext | int. only | int+ext |
| Current requirement/ can. (amps) | 2.9 | 5.9 | 10.5 | 21.0 |
| Total current requirement (amps) (40 × 235°) = 26 cans | 75 | 153 | 273 | 546 |

Figure 7:
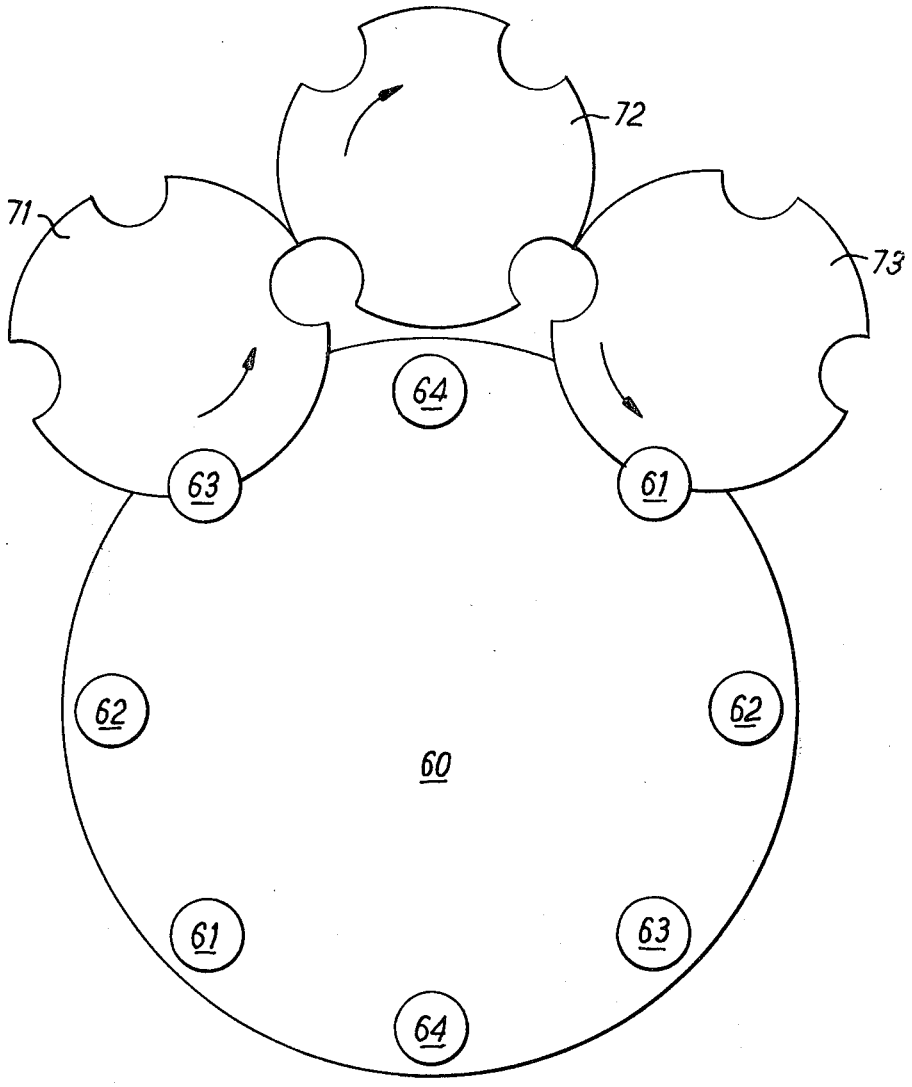
FIG. 7 is a diagram of the apparatus of FIG. 5 and including a transfer turret to permit a sequence of galvanic or other treatments.

However, FIG. 7 shows diagrammatically how a machine 60 having eight cells may be fitted with two sets of four different treatment cells 61, 62, 63, 64. A transfer turret 72 is used to recycle each can from exit star wheel 71 back into the entry star wheel 73 for delivery to the next cell until the four stage treatment is completed. The reader is directed to consult British Patent Application No. 46,460/74 for more detail. A finished coated can may be detected by an electrical conductivity test to prevent continuous cycling through the apparatus.

Examples of treatments which may be carried out, according to the method of the invention, are tabulated below together with the duration of time in seconds expressed as an order of magnetude: for example 3 seconds in the table means a range of from 1 to 9 seconds.

| Example No. | Treatment/use | Time in Seconds order of magnetude |
|---|---|---|
| 1 | Non electrical passivation of Tinplate | 30 |
| 2 | Electrolytic passivation of Tinplate or Blackplate | 3 |
| 3 | Chromating treatment of Aluminium | 10 |
| 4 | Anodising treatment of Aluminium | 3 |
| 5 | Non electrical tin stripping of Tinplate | 30 |
| 6 | Electrolytic tin stripping of Tinplate | 3 |
| 7 | Partial tin srtipping: A.C. Current of Tinplate | 4 |
| 8 | Anionic electrocoating Tinplate or Aluminium but not preferred for Blackplate | 3 |
| 9 | Cationic electrocoating Tinplate or Aluminium | 3 |
| 10 | Hot air drying | 3 |

It is possible to fill or empty each cell, of the treatment fluid (such as would be used for a can 3" diameter by 3" deep) in about ¼ second. Therefore the turret of FIGS. 5 and 6 would rotate at about 10 revolutions per minute when working on a single repair treatment.

The dissolution treatments such as tin stripping or cleaning may be accelerated if desired by applying ultrasonic vibration to the can body. The transducer for such vibration may be situated in the mandrel or in the wall of each cell.

The apparatus of FIGS. 4 to 7 may also be used to carryout a sequence of repair and metal finishing treatments as already described and examples of such sequences follow:

EXAMPLE 1

In the production of plain or lacquered drawn and redrawn cans from tinplate, the following steps are used:

ELECTRO CLEANING → SURFACE TREATMENT → ELECTRO COAT

Electrocleaning as a separate first stage improves the efficiency and uniformity of treatment of the subsequent stages. The surface treatment chosen could be either the equivalent of the known "311" electrochemical process of passivation or the known "300" chemical immersion process of passivation. The choice depending upon the specific application and the need for electrocoating.

EXAMPLE 2

In the production of a drawn and wall ironed beverage container, the following steps may be used:

ELECTRO CLEANING → ELECTRO DETINNING → SURFACE TREATMENT (1) → SURFACE TREATMENT (2) → ELECTRO COATING

In which case, after electrocleaning the tin is stripped from the can by anodic dissolution. Thereafter the additional surface treatment step 1 would be used to replace the tin coating by a film approximately equivalent to that on known steels bearing chromium/chromium oxide layers. The second surface treatment 2 could, if desired, be a passivation treatment. The final stage would be electrocoating with an organic lacquer or the like.

The coating composition used for electrocoating may be a water-dispersed coating composition, such as a partially neutralized acrylic interpolymer and an amine-aldehyde condensation product or polyepoxide or both. Examples of such interpolymers are found listed in the patent issued to Donald P. Hart, U.S. Pat. No. 3,403,088, and assigned to P.P.G. Industries, Inc.

It will be understood that these protective coatings have high di-electric strength, coat metallic articles completely, have efficient electro-depositing qualities, and result in cured films which are clear, glossy and have attractive appearance and good durability.

The apparatus of the invention may alternatively be used as a means to examine the quality of the electrochemical treatment or as a separate apparatus for testing coatings applied by conventional means.

Whilst the invention has been described in terms of cans formed from tin plate and aluminium it is not limited there to, for example the cans may be built up from components made of backplate or other mild steel sheets. Furthermore the cans may be drawn from an uncoated steel so that the method and apparatus described provide the all or part of the can finishing aperatus.

What we claim is:

1. A method of electrolytically treating a surface of a container comprising the steps of placing a container internally of a cavity in external surrounding relationship to a mandrel, introducing an electrolyte through a port into the cavity and selectively (a) conducting the electrolyte through said cavity such that only the outside surface of the container can be electrolytically treated and (b) for conducting electrolyte through said cavity such that only the inside surface of the container can be electrolytically treated and (c) conducting electrolyte through the cavity such that both the inside and outside surfaces of the container can be simultaneously electrolytically treated, applying a potential difference between the cell assembly and the container during any one of steps (a) through (c), draining the electrolyte from the cavity, opening the cavity, and removing the container relative to the cavity.

2. The method as defined in claim 1, wherein the removing step is effected by directing air through the port to expel the container from the open cavity.

3. The method as defined in claim 2, wherein the port is in the mandrel and directs expelling air generally upwardly and axially relative to an associated container axis.

4. Apparatus for electrolytically treating containers comprising a cell assembly having a cell wall surrounding a mandrel and a lid cooperating with the mandrel and cell wall to form a cavity for the reception of a container, the lid being movable into an open position to permit the introduction of a container into and the removal of a container from the cavity, the cavity being a size such that the cell wall cooperates with the outside surfaces of a container in the cavity to form one chamber and the mandrel cooperates with the inside surfaces of the container to form a second chamber, conduit means for introducing an electrolyte into said cavity, the cell wall and the mandrel being spaced so close to the outside and inside surfaces respectively of a container within the cavity that the electrolyte passing through the chambers flows along the surfaces of the container to fill the cavity, electrode means for imposing an electrical potential difference between the cell assembly and the container, and means for supplying air through said conduit means for expelling the container from said cavity upon completion of an electrolytic treatment, said conduit means including selectively operable port means for (a) conducting electrolyte through said cavity such that only the outside surface of the container can be electrolytically treated and (b) for conducting electrolyte through said cavity such that only the inside surface of the container can be electrolytically treated and (c) for conducting electrolyte through said cavity such that both the inside and outside surfaces of the container can be simultaneously electrolytically treated.

5. The apparatus as defined in claim 4 including annular means disposed in said cavity between said cell wall and said mandrel for supporting a flange of the container in spaced relationship to the cell wall and cavity and defining a generally U-shaped passage through which electrolyte can flow between said chambers.

6. The apparatus as defined in claim 4 including annular means disposed in said cavity between said cell wall and said mandrel for supporting a flange of the container in spaced relationship to the cell wall and cavity and defining a generally U-shaped passage through which electrolyte can flow between said chambers, and means for urging the container flange against said flange supporting and passage defining means.

7. The apparatus as defined in claim 4 including annular means disposed in said cavity between said cell wall and said mandrel for supporting a flange of the container in spaced relationship to the cell wall and cavity and defining a generally U-shaped passage through which electrolyte can flow between said chambers, and said electrode means including at least one electrode contacting a portion of the container and urging the same in a direction to urge the container flange against said flange supporting and passage defining means.

8. The apparatus as defined in claim 4 including annular means disposed in said cavity between said cell wall and said mandrel for supporting a flange of the container thereon, and said annular means including means for axially aligning a container relative to said mandrel.

9. The apparatus as defined in claim 4 including annular means disposed in said cavity between said cell wall and said mandrel for supporting a flange of the container thereon, said annular supporting means being in surrounding relationship to said mandrel remote from a terminal end of said mandrel, and said annular supporting means including a plurality of radially directed ribs inclined in a direction radially outwardly and downwardly relative to said terminal end whereby said inclined ribs contact the container flange and thereby axially align the container relative to said mandrel.

10. Apparatus for electrolytically treating containers comprising a cell assembly having a cell wall surrounding a mandrel and a lid cooperating with the mandrel and cell wall to form a cavity for the reception of a container, the lid being movable into an open position to permit the introduction of a container into and the removal of a container from the cavity, the cavity being a size such that the cell wall cooperates with the outside surfaces of a container in the cavity to form one chamber and the mandrel cooperates with the inside surfaces of the container to form a second chamber, conduit means for introducing an electrolyte into said cavity, the cell wall and the mandrel being spaced so close to the outside and inside surfaces respectively of a container within the cavity that the electrolyte passing through the chambers flows along the surfaces of the container to fill the cavity, electrode means for imposing an electrical potential difference between the cell assembly and the container, and means for supplying air through said conduit means for expelling the container from said cavity upon completion of an electrolytic treatment, said conduit means including a pair of ports in said mandrel opening into said cavity through both of which electrolyte flows and through at least one of which air passes to effect the expulsion of a container from said cavity.

11. Apparatus for electrolytically treating containers comprising a cell assembly having a cell wall surrounding a mandrel and a lid cooperating with the mandrel and cell wall to form a cavity for the reception of a container, the lid being movable into an open position to permit the introduction of a container into and the removal of a container from the cavity, the cavity being a size such that the cell wall cooperates with the outside surfaces of a container in the cavity to form one chamber and the mandrel cooperates with the inside surfaces of the container to form a second chamber, conduit means for introducing an electrolyte into said cavity, the cell wall and the mandrel being spaced so close to the outside and inside surfaces respectively of a container within the cavity that the electrolyte passing through the chambers flows along the surfaces of the container to fill the cavity, electrode means for imposing an electrical potential difference between the cell assembly and the container, and means for supplying air through said conduit means for expelling the container from said cavity upon completion of an electrolytic treatment, said conduit means including a pair of ports in said mandrel opening into said cavity through both of which electrolyte flows and through at least one of which air passes to effect the expulsion of a container from said cavity, and said at least one port being an axial port opening into said cavity through a terminal end portion of said mandrel.

12. Apparatus for electrolytically treating containers comprising a cell assembly having a cell wall surrounding a mandrel and a lid cooperating with the mandrel and cell wall to form a cavity for the reception of a container, the lid being movable into an open position to permit the introduction of a container into and the removal of a container from the cavity, the cavity being a size such that the cell wall cooperates with the outside surfaces of a container in the cavity to form one chamber and the mandrel cooperates with the inside surfaces of the container to form a second chamber, conduit means for introducing an electrolyte into said cavity, the cell wall and mandrel being spaced so close to the outside and inside surfaces respectively of a container within the cavity that the electrolyte passing through the chambers flows along the surfaces of the container to fill the cavity, electrode means for imposing an electrical potential difference between the cell assembly and the container, and said conduit means includes selectively operable port means for (a) conducting electrolyte through said cavity such that only the outside surface of the container can be electrolytically treated and
(b) for conducting electrolyte through said cavity such that only the inside surface of the container can be electrolytically treated and
(c) for conducting electrolyte through said cavity such that both the inside and outside surfaces of the container can be simultaneously electrolytically treated.

13. The apparatus as defined in claim 12 wherein said port means includes a first port in said mandrel opening into said second chamber, a second port in said cell wall opening into said one chamber, a third port between said first and second ports, and means for closing off fluid communication of said third port with said first and second ports.

14. The apparatus as defined in claim 12 including annular means disposed in said cavity between said cell wall and said mandrel for supporting a flange of the container in spaced relationship to the cell wall and cavity and defining a generaly U-shaped passage through which electrolyte can flow between said chambers.

15. The apparatus as defined in claim 12 including annular means disposed in said cavity between said cell wall and said mandrel for supporting a flange of the container in spaced relationship to the cell wall and cavity and defining a generally U-shaped passage through which electrolyte can flow between said chambers, and means for urging the container flange against said flange supporting and passage defining means.

16. The apparatus as defined in claim 12 including annular means disposed in said cavity between said cell wall and said mandrel for supporting a flange of the container in spaced relationship to the cell wall and cavity and defining a generally U-shaped passage through which electrolyte can flow between said chambers, and said electrode means including at least one electrode contacting a portion of the container and urging the same in a direction to urge the container flange against said flange supporting and passage defining means.

17. The apparatus as defined in claim 12 including annular means disposed in said cavity between said cell wall and said mandrel for supporting a flange of the container thereon, and said annular means including means for axially aligning a container relative to said mandrel.

18. The apparatus as defined in claim 12 including annular means disposed in said cavity between said cell wall and said mandrel for supporting a flange of the container thereon, said annular supporting means being in surrounding relationship to said mandrel remote from a terminal end of said mandrel, and said annular supporting means including a plurality of radially directed ribs inclined in a direction radially outwardly and downwardly relative to said terminal end whereby said inclined ribs contact the container flange and thereby axially align the container relative to said mandrel.

* * * * *